US010882100B2

(12) United States Patent
Guthrie et al.

(10) Patent No.: US 10,882,100 B2
(45) Date of Patent: Jan. 5, 2021

(54) METHOD AND APPARATUS FOR NEAR NET SHAPE CASTING (NNSC) OF METALS AND ALLOYS

(71) Applicant: METSIM Inc., St-Laurent (CA)

(72) Inventors: Roderick Guthrie, Westmount (CA); Mihaiela Isac, Hampstead (CA)

(73) Assignee: MetSim Inc., Montreal (CA)

( * ) Notice: Subject to any disclaimer, the term of this patent is extended or adjusted under 35 U.S.C. 154(b) by 192 days.

(21) Appl. No.: 15/994,111

(22) Filed: May 31, 2018

(65) Prior Publication Data

US 2019/0105707 A1 Apr. 11, 2019

Related U.S. Application Data

(60) Provisional application No. 62/568,433, filed on Oct. 5, 2017.

(51) Int. Cl.

| | |
|---|---|
| ***B22D 11/06*** | (2006.01) |
| ***B22D 11/103*** | (2006.01) |
| *B22D 11/119* | (2006.01) |
| *B22D 11/14* | (2006.01) |

(52) U.S. Cl.

CPC ..... *B22D 11/0642* (2013.01); *B22D 11/0631* (2013.01); *B22D 11/103* (2013.01); *B22D 11/0685* (2013.01); *B22D 11/119* (2013.01); *B22D 11/143* (2013.01)

(58) Field of Classification Search

CPC . B22D 11/06; B22D 11/0631; B22D 11/0642; B22D 11/0685; B22D 11/103; B22D 11/119; B22D 11/143

USPC ..... 164/479, 427, 429, 488, 489, 437

See application file for complete search history.

(56) References Cited

U.S. PATENT DOCUMENTS 4,776,570 A * 10/1988 Vo Thanh et al. .... B22D 11/118 266/229

5,063,990 A * 11/1991 Follstaedt et al. ... B22D 11/064 164/423

OTHER PUBLICATIONS

M. Xu et al.; A Numerical Simulation of Transport Phenomena During the Horizontal Single Belt Casting Process Using an Inclined Feeding System; Metallurgical and Materials Transactions B; Mar. 16, 2018.

R.I.L. Guthrie et al.; Conventional and near net shape casting options for steel sheet; Ironmaking and Steelmaking; Aug. 22, 2016.

(Continued)

*Primary Examiner* — Kevin P Kerns

(74) *Attorney, Agent, or Firm* — Norton Rose Fulbright Canada LLP

(57) ABSTRACT

A method and apparatus for continuous Near Net Shape casting of a liquid metal (10) into a metal strip are described. Liquid metal is transferred in a velocity adjusted manner from a headbox (50) to a chilled substrate (36), via a meniscus gap (69). The headbox (50) has a slot nozzle (68) defined in a bottom portion (66) for the headbox (50) above the chilled substrate (36). The slot nozzle (68) defines a smooth elongated cavity with a slot width (67) and the slot length (65) of the metal strip (34). The generation of some turbulence at the outlet of the apparatus promotes stable Near Net Shape Continuous Casting. The present method and apparatus increase the level of turbulence in the liquid metal of the outlet nozzle upstream of the chilled substrate (36) to minimize premature metal freezing. In a particularly preferred embodiment, the slot nozzle is adjustable.

22 Claims, 8 Drawing Sheets

(56) References Cited

OTHER PUBLICATIONS

R.I.L. Guthrie et al.; The Near Net Casting of Steels; The Way Forward?; Int. Conf. on Science & Technology Iron and Steelmaking; 2013.
S. Ge et al.; Progress in Strip Casting Technologies for Steel; Technical Developments; ISIJ International; 2013.
R.I.L. Guthrie et al., Horizontal Single Belt Casting of Aluminum and Steel; 5th Int. Congress on the Science and Technology of Steelmaking, Dresden; Oct. 1-3, 2012.
S. Ge et al., Progess of Strip Casting Technology for Steel; Historical Developments; ISIJ International; 2012.
R. Guthrie et al., The Development of Continuous Casting Machines for the Production of Steel in North America; Continuous Casting Book, ISBN 978-3-402-13294-4; 2015.
R.I.L. Guthrie; Fluid Flows in Metallurgy—Friend or Foe?; Metallurgical and Materials Transactions B; Jun. 2004.

* cited by examiner

METHOD AND APPARATUS FOR NEAR NET SHAPE CASTING (NNSC) OF METALS AND ALLOYS

TECHNICAL FIELD

The present description relates to a method of continuous metal casting and an apparatus for casting metal strips, particularly by Near Net Shape Continuous Casting, in a velocity adjusted manner, and in a preferred embodiment through an adjustable slot nozzle.

BACKGROUND

Conventionally, steel, in various cross-sections, is produced by rolling a continuously cast slab through a sequential series of about seven hot rolling stands in the Hot Rolling Mill, in order to produce shapes of reduced cross-section, as required. The thinner the final product, the more passes are required through the (hot) rolling mill. This means a greater number of rolling mills in tandem. Alternatively, it requires many more passes through a single rolling mill (e.g. a Steckel) mill). In order to save costs, a number of continuous casting methods have been developed, in which the casting product dimensions approach the dimensions of conventional, hot rolled products. In this way, conventional multi-stand hot rolling operations can largely be by-passed, and the capital cost of machinery and labor reduced substantially. This consideration has led to the development of Thin Slab Casting Machines, that are able to produce slabs in the order of 60-80 mm thickness, at casting velocities in the order of 5-6 m/s, so as to maintain equivalent productivity with thick slab casters. However, for the 1 to 20 millimeter thickness range, the ever higher velocities that would be needed to maintain an equivalent high productivity output of 100 tph/m width, competitive with today's big slab casters, would result in an unacceptable likelihood of skin rupture, if using a stationary, or rather a fixed, oscillating mold, with a lubricating slag, type of technology.

The problem of surface quality defects caused by the relative movement between solidifying metal and a mold can be overcome by using a twin roll caster of the type originated and conceived by Bessemer in 1865.

In the Bessemer method, molten metal is poured between two internally water cooled rolls, rotating inwardly towards the liquid metal. Complete solidification of the strip must take place at the roll nip. In this way, a continuously moving mold surface is provided, and the undesirable consequences of the differential velocity between solidifying metal and a mold, are substantially eliminated.

However, while it is possible to produce steel strip having a thickness of 1 to 20 millimeters using a Twin-Roll caster, it becomes necessary to increase the size of the rolls to perhaps unreasonable proportions (e.g. 3 m diameter for 12 mm thick product assuming a maximum subtended pool angle of 60° and a solidification constant of 20 mm/minute$^{1/2}$), in order to provide sufficient residence time for cooling, if throughputs in the order of 100 tons per hour per meter width of product, are to be achieved.

Nonetheless, one TRC (Twin Roll Casting) method that is now commercial, is CASTRIP. However, the TRC method does not enable one to produce steel at reasonably high tonnages, in the order of 100 tons per hour per meter width of product, but is restricted to about half that amount of product, making it unsuitable to replace current slab casting machines. Other problems which the Bessemer type method does not readily overcome, include melt edge containment, exposure to air, surface lapping marks, and providing a consistent liquid metal feed, uninterrupted by turbulence, across the whole width of the rolls. Similarly, cooling rates are very high (~1000° C./s), leading to Wdmanstatten Structures within a low carbon frozen steel, that are not helpful to a steel's ductility. This has led to a general rejection of the method by integrated steel manufacturers in Japan and Europe.

Another approach to providing a continuously moving mold surface, is to cast liquid metal onto a single roll. For example, in the "melt drag" method, a molten meniscus exiting from an orifice is dragged onto a cooled, rotating drum.

The molten metal solidifies upon contacting the metal drum and is then stripped, as the drum rotates. Because the metal solidifies primarily from one side only, and because the residence time on such a drum is short, if the proportions of the drum are to be within reasonable limits, the thickness of the strip is limited to a maximum of about 1 to 2 millimeters. Similar thickness limitations apply to a variant of this process known as planar flow casting.

In U.S. Pat. No. 4,646,812 to Maringer, a process is proposed for casting metallic strips thicker than those made by the melt drag method. Maringer teaches a process in which molten metal is delivered from a tundish to a moving chill surface, the tundish having a slot-like discharge opening at an upstream end, to cast metal into a channel defined by the bottom surface of the tundish, and the chill surface. The molten top surface of the metal cast exiting the channel is "squeegeed" at a down-stream end, by a roll.

This is in contrast to the process proposed in U.S. Pat. No. 4,086,952 to Olsson in which a casting station comprises a chill surface moved continuously in contact with a pool of molten metal supplied from a first tundish, having an open bottom. The thickness of solidified strip is increased at a succession of casting stations provided in series to a required height.

The bottom of the tundish in the Maringer process defines a floor or element which, when compared with Olsson, will limit the effects of convection in the molten metal pool adjacent to the solidifying metal. The residence time on Maringer's chill surface beneath the tundish is controlled by the rate of flow of molten metal through the slot-like discharge opening and the speed of the chill surface. Maringer also describes a maximum thickness of cast strip limited to the inherent normal thickness of a cast metal attributable to surface tension.

Another patent of interest is U.S. Pat. No. 3,354,937 to Jackson which describes a tundish provided with an orifice plate at the bottom, so as to deposit dashes of molten metal, which freeze instantaneously, at least initially, onto a moving chill surface, and subsequently, on top of the previously frozen metal. Unfortunately, the maximum thickness of cast strip which can be obtained in a reasonable time period is limited.

Another method of continuously casting metal onto a single, continuously moving mold surface, is an open trough horizontal casting method, in which molten metal is poured onto a series of chill molds, or a moving belt. While it is possible to produce strip having a thickness of 12 to 20 millimeters, at reasonable production rates, the surface quality of the sheet tends to be poor because of exposure to air. The method allows oxidation, turbulence effects, and the entrapment of gases below an upper skin, formed by radiative heat losses. Similarly, with free pouring, the lower surface of the casting exhibits cold shuts and lap defects, if using a direct chill metal mold. This can be solved by the provision of a thermally insulating layer which carries a high cost penalty for thin strip casting.

Still another approach is to provide a continuously moving mold, such as that found in the Twin Belt Caster developed by Hazelett. In this structure, a pair of thin steel belts move in parallel with one of the belts carrying a continuous chain of dam blocks, to define the sides of the mold. A major problem arises when applying this process to the production of thin strip, because it is both difficult to provide uniform delivery of liquid metal through the inlet, and to match the speed of the belt with the demand for liquid metal.

A further problem exists when using narrow and wide pouring nozzles, as freezing can occur between the nozzle and the "cold" belts, and this can interfere with metal delivery to the belt.

The U.S. Pat. No. 4,928,748 incorporated in its entirety herein by reference, teaches a continuous method of thin metal strips but includes a pervious flow restricting element meant to remove impurities in the melt, thereby delivering molten metal to the chilled substrate carrier in a generally closed manner. This pervious flow restricting filtering outlet element adjacent the chilled substrate, releases metal in a completely laminar flow regime below a Reynolds number of 1500, but is subject to blockages that could affect the quality of the cast strip/slab.

SUMMARY

In one aspect there is provided an apparatus for continuous Near Net Shape casting of a liquid metal into a metal strip having a strip width and a strip thickness on a chilled substrate moving in a first direction, the apparatus comprising: a head box proximal to and above the chilled substrate, wherein the head box is adjacent to and hydraulically connected to a launder supplying the liquid metal, the head box comprising: a compartment receiving the liquid metal from the launder, the compartment comprising a front wall comprising a reverse flow wall within the compartment; two opposite side walls attached to the front wall, a weir attached to the two opposite side walls and opposite the front wall, a bottom portion attached to each of the front wall, the two opposite side walls and the weir wherein a combination of the bottom portion, the front wall, the two opposite side walls and the weir retaining the liquid metal; and a dam in the bottom portion positioned longitudinally between the two opposite side walls and located between the weir and the reverse flow wall; wherein the weir defining an opening adjacent to the bottom portion allowing passage of the liquid metal into the compartment; wherein the bottom portion defining a slot nozzle above the chilled substrate, and an angled back-wall positioned longitudinally between the two opposite side walls and located between the bottom portion and the chilled substrate, wherein the slot nozzle is located between the dam and the reverse flow wall, the slot nozzle defining a smooth elongated cavity with a slot width and a slot length in the bottom portion, the slot width defined between the dam and the reverse flow wall and the slot length defined between the two opposite side walls, the slot nozzle transferring the liquid metal to the angled back-wall, wherein the smooth elongated cavity is located above the angled back-wall, and wherein the angled-back wall and the chilled substrate are separated by a meniscus gap.

In another aspect there is provided the apparatus described herein, wherein the slot width is less than, equal to, or greater than the strip thickness.

In yet another aspect there is provided the apparatus described herein, wherein the angled back-wall has a slope that makes an acute angle θ with the horizontal in relation to the metal strip and is from 30° to 70°.

In still yet another aspect there is provided the apparatus described herein, wherein the acute angle θ is 45°.

In still yet another aspect there is provided the apparatus described herein, wherein the angled back-wall has an upper portion that is a vertical back-wall located below and in-line with the smooth elongated cavity.

In still yet another aspect there is provided the apparatus described herein, wherein a slot width is defined between a first nozzle wall and a second nozzle wall in the bottom portion, the first nozzle wall proximal the dam and the second nozzle wall opposite the first nozzle wall, and wherein the vertical back-wall is aligned with the first nozzle wall.

In still yet another aspect there is provided the apparatus described herein, wherein the dam further comprises an upper weir regulating the flow of liquid metal into the compartment.

In still yet another aspect there is provided the apparatus described herein, wherein the bottom portion includes an downwardly projecting arm below the slot nozzle adapted to move the liquid metal in a second direction opposite the first direction towards the angled back wall and then downward through a plurality of flow directing elements before dropping onto the chilled substrate.

In still yet another aspect there is provided an apparatus for continuous Near Net Shape casting of a liquid metal into a metal strip having a strip width and a strip thickness on a chilled substrate moving in a first direction, the apparatus comprising: a head box proximal to and above the chilled substrate, wherein the head box is adjacent to and hydraulically connected to a launder supplying the liquid metal, the head box comprising: a compartment receiving the liquid metal from the launder, the compartment comprising an upper portion and a bottom portion opposite the upper portion; an angled front wall comprising a reverse flow wall within the compartment wherein the angled front wall is attached to the upper portion through a pivoting device; two opposite side walls proximal to and sealingly engaging the angled front wall; a weir attached to the two opposite side walls and opposite the angled front wall; a bottom portion attached or proximal to each of the angled front wall, the two opposite side walls and the weir wherein a combination of the bottom portion, the angled front wall, the two opposite side walls and the weir retaining the liquid metal; and a dam in the bottom portion positioned longitudinally between the two opposite side walls and located between the weir and the reverse flow wall, wherein the weir defining an opening adjacent to the bottom portion allowing passage of the liquid metal into the compartment; wherein the bottom portion serving as a back-wall proximal to the reverse flow wall defining a slot nozzle therebetween and above the chilled substrate, and wherein the slot nozzle defining a smooth elongated cavity with a slot width and a slot length, the slot width defined between the back-wall and the reverse flow wall and the slot length defined between the two opposite side walls, the slot nozzle transferring the liquid metal to the chilled substrate, wherein the back wall and the chilled substrate are separated by a meniscus gap and wherein the front wall is movable around the pivoting device and capable of increasing or decreasing the slot width.

In still yet another aspect there is provided the apparatus described herein, wherein the reverse flow wall makes an obtuse angle γ with the horizontal in relation to the metal strip and is from 120° to 160°.

In still yet another aspect there is provided the apparatus described herein, wherein the obtuse angle γ is 135°.

In still yet another aspect there is provided the apparatus described herein, wherein the back wall makes an acute or perpendicular angle with the horizontal in relation to the metal strip.

In still yet another aspect there is provided the apparatus described herein, wherein the acute angle is substantially parallel with the obtuse angle.

In still yet another aspect there is provided the apparatus described herein, wherein the reverse flow wall comprises a lower surface having a curved edge adjacent to the chilled substrate curving outwardly towards and proximal with the back-wall and defining the slot nozzle therebetween, wherein the curved edge is adapted to move the liquid metal out of the slot nozzle at least partially in a second direction opposite the first direction.

In still yet another aspect there is provided the apparatus described herein, wherein the reverse flow wall further comprises a rounded surface projecting from the curved edge adjacent the back-wall in the first direction adjacent the chilled substrate.

In still yet another aspect there is provided the apparatus described herein, wherein the reverse flow wall comprises a straight wall lower surface aligned with the back-wall having an angled bottom portion and defining the slot nozzle therebetween, wherein the curved edge proximal the chilled substrate (36) is adapted to move the liquid metal out of the slot nozzle at least partially in a second direction opposite the first direction.

In still yet another aspect there is provided the apparatus described herein, wherein the pivoting device pivots around one line parallel to the front wall.

In still yet another aspect there is provided the apparatus described herein wherein the pivoting device pivots around one line parallel to the front wall and further comprises at least one of a fine horizontal movement adjustment and a fine vertical movement adjustment providing an fine adjustment to the slot width varying the strip thickness.

In still yet another aspect there is provided a method for continuous Near Net Shape Casting of a liquid metal into a metal strip having a strip width and a strip thickness on a chilled substrate moving in a first direction, the method comprising: transferring the liquid metal to a head box in a controlled manner, the head box comprising: a compartment receiving and calming the liquid metal, the compartment comprising an upper portion and a bottom portion opposite the upper portion; a front wall movably attached in the upper portion, the front wall comprising a reverse flow wall within the compartment reversing the flow of the liquid metal at least partially in a second direction opposite the first direction, wherein the reverse flow wall adjacent to the bottom portion and defining a slot nozzle therebetween; wherein the slot nozzle defining a smooth elongated cavity with a slot width and a slot length, the slot width is adjustable and defined in the first direction and the slot length is defined in a plane perpendicular the first direction, and transferring the liquid metal in a velocity adjusted manner through the slot nozzle at least partially in the second direction to the chilled substrate above a meniscus gap defined between the bottom portion and the chilled substrate.

In still yet another aspect there is provided the method described herein, wherein the slot length is greater than or less than the strip width.

In still yet another aspect there is provided the method described herein, wherein the slot length is equal to the strip width.

In still yet another aspect there is provided the apparatus described herein, wherein the slot width is less than, equal to, or greater than the strip thickness.

In view of the above, one aspect of the apparatuses and method described herein is to provide a Near Net Shape Continuous Casting method that allows for: varying strip/slab thicknesses (from about 0.2 to 20 millimeters); high production rates from 100 tons per hour, or more, per meter width of product; a reduction of skin friction between a solidifying shell and a cooled surface; reduction of re-oxidation; a reduction of turbulence-related defects; a reduction of premature and irregular freezing at chill surfaces, and poor surface quality resulting from inadequate feed control, while at the same time being free of any hydraulic jump and free of any (significant) pervious flow restricting element at the feed outlet nozzle above the chilled carrier. The present method can also be adapted to lower production rates (of less than 100 tons per hour per meter width of product). The present method and apparatus also overcomes the problems that occur when using open systems with narrow, very wide, (or wide) pouring nozzles.

The present method and apparatus reduce freezing that occurs between the nozzle and the chilled belts of open casting systems, that interfere with metal delivery to the belt and that reduce the quality of the cast strip/slab. It has been surprisingly found that the generation of some turbulence at the outlet of the apparatus described herein promotes stable Near Net Shape Continuous Casting. The present method and apparatus increase the level of turbulence in the liquid metal of the outlet nozzle to minimize premature metal freezing. The presently described method and apparatus relate to preferred delivery systems for delivering liquid metal onto the moving, water-cooled belt carrier. In this way, the present apparatus aims to produce sheet material that can be up to 2-3 m wide, with thicknesses that can range between 200 microns, up to 20 mm, at velocities that can potentially vary between 0.1 and 20.0 m/s (or 6 to 1,200 m/minute), depending on the length of the water cooled belt, and its cooling capacity in a vertical unconstrained manner.

In accordance with one aspect herein described, there is provided an enclosed extended chamber or compartment, there is a smooth velocity increasing outlet/nozzle, where in a preferred embodiment the nozzle has an adjustable internal aperture, for delivering metal by Near Net Shape Continuous Casting onto the belt/carrier. In one aspect described herein, the method and apparatus replace the pervious filters in U.S. Pat. No. 4,928,748, above the chilled carrier with a flow modifier means that will create a region of controlled turbulence and a reduction in vertical kinetic energy.

DETAILED DESCRIPTION

The present casting method and apparatus will be described with reference primarily to steelmaking, and to aluminum casting, but it will be appreciated that the apparatuses and the method described herein can be useful in the continuous casting of other metals and alloys.

Definitions

Near Net Shape Continuous Casting is defined herein, as a method of producing strips/slabs in a molten and/or semi-molten shape that is very similar to a final shape of the strip/slab required of a final/finished sheet product.

An open casting system is one where the nozzle is free of a pervious outlet nozzle and delivers metal onto the chilled carrier by means of a velocity adjusted delivery near and/or under turbulent flow conditions.

A velocity adjusted delivery of a molten metal is a system that increases or changes the speed of the molten metal, such that it is increased towards near turbulent flow conditions in the transition zone of Re, [Reynolds number], between 2400 and 4000, preferably approaching 2300, and more preferably between Re=1600 to 2000, for flows in pipes, and similar enclosures. Specifically, laminar flow occurs at lower Reynolds numbers, where viscous forces dominate over inertial flows, and are characterized by smooth fluid motion. In the preferred embodiment, the velocity adjusted delivery occurs via a reverse flow system that moves the molten liquid out of a slot nozzle in a direction opposite to that of the carrier at least partially. However, the flow in other embodiments may be in the same direction as the carrier, but again include the generation of turbulence kinetic energy, so as to maintain near isothermal conditions within all of the liquid metal within the delivery system, including the back-wall multiphase meniscus (back-wall refractory, liquid metal meniscus, cooled belt or carrier, and the gaseous atmosphere), where freezing is likely to occur under normal conditions.

Forward momentum of the liquid metal is defined herein as that in the direction of the chilled belt/substrate.

Dissipating forward momentum of the liquid metal from the apparatus and/or slot nozzle means that the molten metal arriving at the chilled carrier includes the generation of turbulent kinetic energy.

Hydraulic jump is defined herein as a disparity between the molten metal entry and the belt/carrier velocities. With the present method and apparatus described herein, the metal on the belt/carrier have substantially the same velocity, and the method and the apparatus described herein are substantially free of a hydraulic jump.

An acute angle is understood to be an angle of less than 90°. An obtuse is understood to as an angle of greater than 90° and less than 180°.

Figure 1:
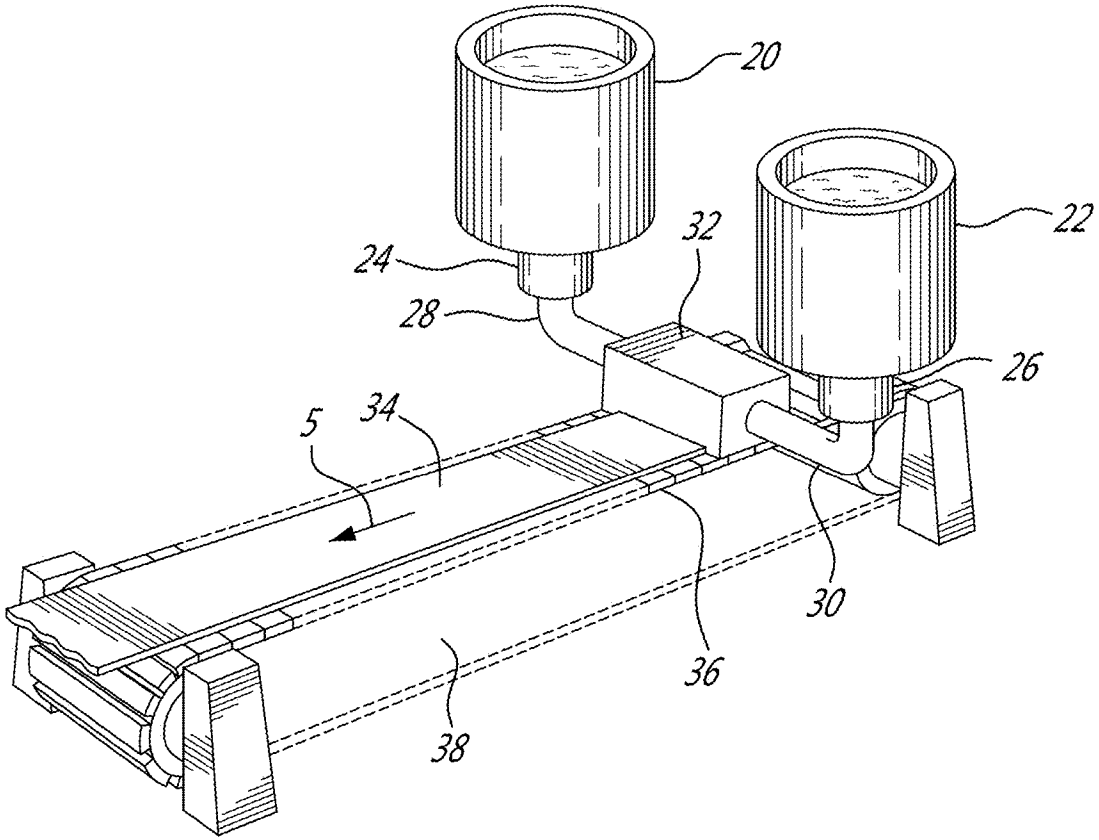
FIG. 1 (PRIOR ART)
FIG. 1 is a perspective view schematic representation showing a Horizontal Single Block Caster (HSBC) of U.S. Pat. No. 4,928,748 (PRIOR ART)

FIG. 1 illustrates a schematic isometric representation of a casting apparatus of the prior art where molten liquid metal is fed directly from one of two ladles 20, 22 via control valves 24, 26 which are used to selectively receive molten metal from one of the ladles while the other is being withdrawn and replenished with a new ladle of liquid metal. The melt passes via insulated ducts 28, 30 to a tundish 32 which, defines downstream, upstream and side dams (not illustrated) with a cast strip 34 leaving the tundish 32 carried by a chilled substrate 36 in the form of a generally horizontal endless belt forming part of a chilled transporter 38, moving in direction 5. The term "endless belt" will be understood to include a continuous belt or a series of blocks arranged to form a belt (sometimes known as a "block caster"). The parts are of course shown diagrammatically and such devices as the transporter 38, ladles 20, 22 and valves 24, 26 are intended to represent conventional devices. The prior art apparatus of FIG. 1 includes a pervious element at the outlet that delivers the molten metal to the carrier in a controlled, laminar flow regime, that may be subject to blockages by inclusions within the liquid metal.

Reference is next made to FIGS. 2 to 8, which show various views of the apparatus herein described, including preferred embodiments of the headbox 50 (FIG. 2) described herein.

Figure 2:
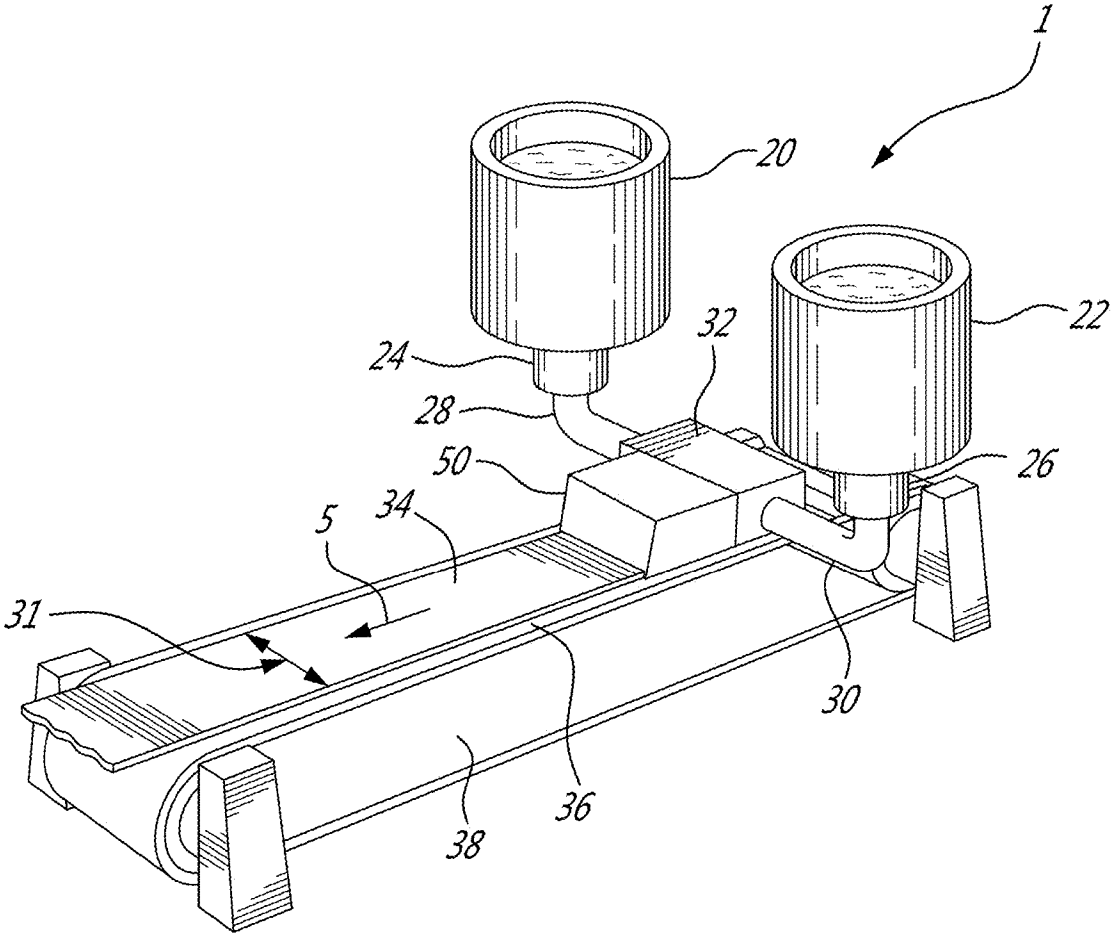
FIG. 2 is a perspective view schematic representation, showing a conventional horizontal belt caster including a headbox according to one embodiment of described herein downstream of a launder/tundish.

FIG. 2 is a schematic representation of the headbox 50 that in this embodiment is illustrated adjacent to and in liquid communication with a tundish 32. The skilled person would understand that the headbox 50 may be adapted to receive the molten metal directly, making the tundish 32 and a launder 33 within the headbox 50 equivalents.

Figure 3A:
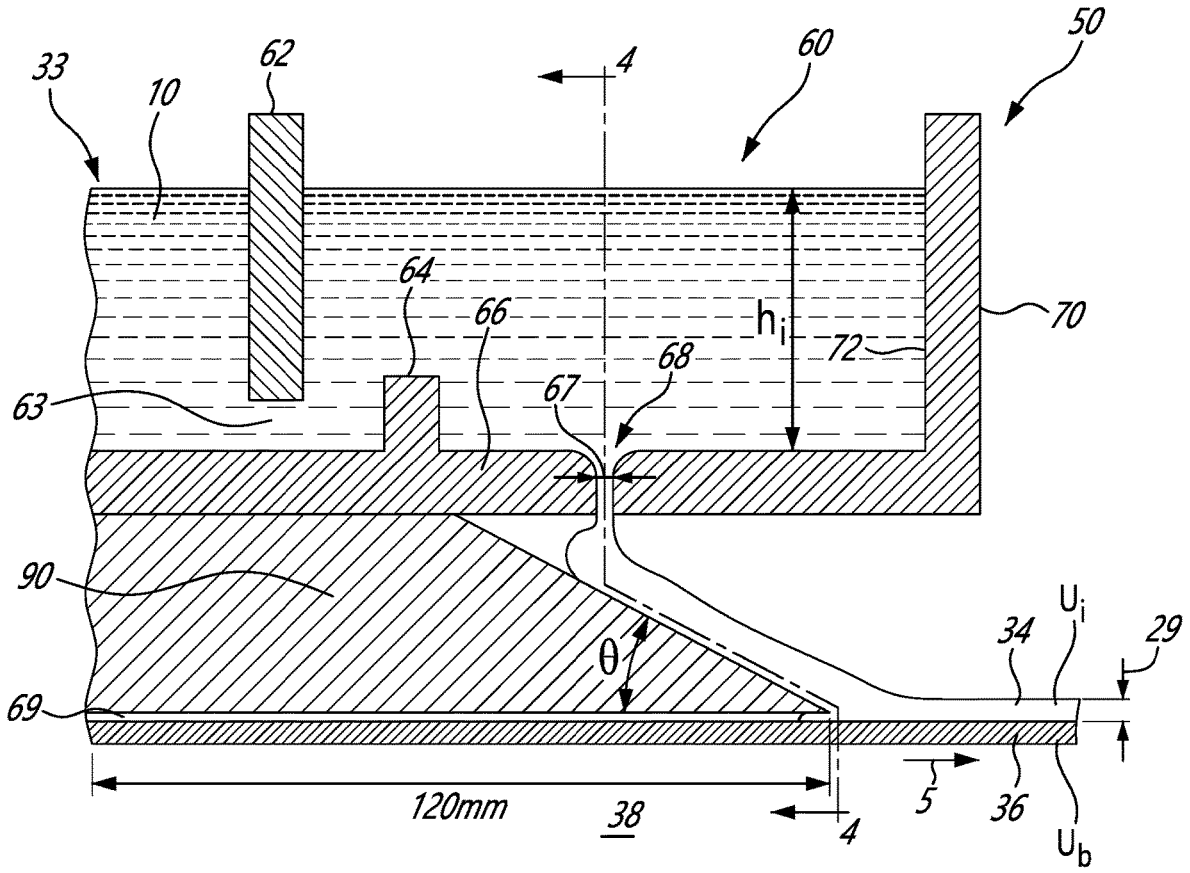
FIG. 3A is a cross-sectional view through a headbox, according to one embodiment of described herein.

FIG. 3A illustrates a cross-sectional view through the headbox 50 above the transporter 38 moving in a direction 5. As can be seen, the headbox 50 is in liquid communication with either a tundish 32 or as illustrated in FIGS. 3A-3D, a launder 33. The molten liquid metal 10, is maintained at a constant height (hydrostatic head) in the headbox 50 by the upstream equipment previously described, including the ladles 20, 22 and valves 24, 26.

The liquid metal 10 passes from the tundish 32 or launder 33 via a weir 62 defining a lower opening 63 permitting passage of the liquid metal 10 into an enclosed compartment 60 of the headbox 50. In a preferred embodiment the opening 63 is 12 mm. In one embodiment described herein, the liquid head throughout the headbox 50 (i.e. in both the launder 33 and the compartment 60) is 50 mm.

It is understood that the headbox 50, with launder 33, compartment 60 (and/or tundish 32) are enclosed, the sealing roof element has not been illustrated in FIGS. 3A, 3B, 3D, 4, 7A, 7B and 8.

The method illustrated here involves using a vertical insulated stopper plate (not illustrated), in order to prevent the premature flow of metal 10 through the head box 50, until the head of metal is sufficient to allow flow through the slot nozzle 68.

The compartment 60 comprises a dam 64 downstream of the weir 62 and upstream of a slot nozzle 68 in the bottom portion of the headbox 66. The horizontal distance between the weir 62 and the dam 64 in a preferred embodiment is 20 mm. The dam 64 serves to deviate the flow of liquid metal 10 upstream of the slot nozzle 68. In a preferred embodiment, the dam 64 at least a height of 25 mm. The weir 62 and dam 64 arrangement may be a porous filtering material suitable for cleaning the liquid metal.

The compartment 60 includes an outer wall 70 that includes an opposite and internal reverse flow generating wall 72. In a preferred embodiment the reverse flow generating wall 72 dissipates forward momentum of the liquid metal 10. The reverse flow generating wall 72 works in combination with the dam 64, and the slot nozzle 68. These three features help to ensure that the movement of liquid metal 10 out the slot nozzle 68 in a flow direction that is velocity adjusted, or at least includes the generation of turbulence energy. In this manner, the molten metal from the slot nozzle 68 will likely not freeze prematurely on the substrate 36.

The method described herein includes a low head launder for delivering liquid metal 10 onto a moving, water cooled, horizontal belt/substrate 36, running at low (less than 0.1 m/s) but also at higher speeds (0.1-10 m/s). The liquid metal delivery systems described, place liquid metal onto the belt/substrate 36 in a well-controlled velocity adjusted manner, using metal delivery elements that shape the flows of liquid metal onto the belt so as to render them isokinetic with the belt before any substantial freezing takes place. The expression controlled manner or velocity adjusted manner is therefore understood as one that equalizes the velocities of the molten metal liquid 10 and the cooled substrate 36. The liquid then solidifies upwards from the cooling belt in an isokinetic fashion. In a preferred embodiment, downstream gas flows can be used to protect the upper surface from oxidation, and/or to promote solidification if necessary, and selected upstream gas flows at the triple point, to optimize the quality of the bottom surfaces of the casting. The metal feeding arrangements can minimize the exposure of liquid metals and alloys to ambient air, and maximize turbulent kinetic energy dissipation so as to promote isokinetic flow conditions within open, or enclosed, extended liquid metal delivery work zones.

The slot nozzle 68 in a preferred embodiment is a hydrostatically smooth or contoured slot, producing a smooth increase in liquid velocity, thereby decreasing turbulence out of the slot. The slot nozzle 68 in a preferred embodiment has a 3 mm slot width 67, sw, at its narrowest point, and includes a wider smooth entry opening of at least 10 to 12 mm. This orderly decrease in slot width 67 size accelerates the velocity of the molten metal out of the slot nozzle 68. The slot width 67, sw, is defined in a direction 5 of the chilled substrate 36 and between the dam 64 and the reverse flow wall 72. The slot nozzle 68 includes a transverse horizontal length 65—with a dimension between 100 mm to 1 meter or more. The transverse horizontal slot length 65 of the slot nozzle 68 may, in a preferred embodiment, be limited by the side dams (not illustrated). The slot nozzle 68 may be positioned directly above the carrier 38. In a preferred embodiment the slot nozzle may define an opening that is convergent (with walls coming together and having larger inlet and/or outlet). In yet another embodiment the slot nozzle may define an opening that is divergent (with wall moving apart and having smaller inlet and/or outlet).

The height of liquid metal in the launder 33 can be varied gradually, and precisely, so as to be able to create the necessary hydrostatic pressure required to create the height of liquid metal, $h_l$, that needs to be deposited onto the chilled substrate 36. Similarly, this height must also simultaneously match the potential energy thereby produced, to meet the kinetic energy requirements of the exiting liquid metal, $U_l$, so that its overall speed matches the belt speed, $U_b$. The skilled person will also take into consideration the heat extraction capabilities of the water-cooled belt, and the belt's cooling length, to check that the overall system balances correctly. This will assure that the metal strip 34 formed and coming off the substrate 36 onto the motorized table rolls, is at the correct solidus temperature, for subsequent thermo-mechanical processing.

There may in a preferred embodiment be an air space, at the outlet of the slot nozzle 68, between bottom portion 66 of the headbox 50. There is importantly, a meniscus gap 69 between the back wall 90 and the substrate 36, that in a preferred embodiment is between 0.2 and 1 mm, and more preferably between 0.8 and 1.0 mm in height.

The moving chilled substrate 36 can either be coated with graphite powder or vegetable oil, or equivalent, so as to ensure a good surface finish to the bottom surface of the aluminum, or steel, strip being formed. Alternatively, it may be useful to use an uncoated belt, for enhanced heat transfer, but to use advantageous interfacial gases, so as to displace air from bottom interface. In the case of casting aluminum, oxygen is a good choice, as it reacts with aluminum to reduce the volume of the interfacial gas, and produce a blemish-free bottom surface. Similarly, the gas flowrate must not be too high, since the back-wall meniscus gap 69 is then penetrated, and the bottom surface of the forming sheet may be compromised. The top surface of the strip 34 may be inert gas covered, so as to protect the metal from oxidation in air if required.

In a preferred embodiment that is represented in FIG. 3A, the molten metal liquid 10 exiting the slot nozzle 68 from the bottom portion 66 of the headbox 50, may fall onto an angled back-wall 90. In a preferred embodiment the angle θ with the horizontal of the angled back-wall in relation to the metal strip 34 is between 30° and 70°. In a particularly preferred embodiment, the angle θ of the angled back-wall is 45° with the horizontal (as illustrated in FIG. 3A) in relation to the metal strip 34. The vertical height of the angled back-wall is in a preferred embodiment is 25 to 30 mm, and more preferably 29 mm. In one embodiment the outlet of the slot nozzle 68 can be positioned at approximately the mid-point of the angled back-wall 90. This positioning of the slot nozzle with respect the angled back-wall helps ensure a smooth, and generally controlled turbulent flow of liquid metal (i.e. generation of turbulence energy) down the angled back-wall slope and at an increased forward velocity and momentum for the liquid metal than would have been the case had there been no slope. In this case, the velocity adjusted flow is clearly further affected by the back-wall 90, along with the reverse flow generating wall 72, the dam 64, and the slot nozzle 68. The slope of the angled back-wall serves to increase the velocity and momentum onto the carrier and the level of turbulence of the liquid metal onto the carrier, avoiding pre-mature freezing and blockages, while the side dams limit the width of the strip being cast. The back-wall 90 of the delivery system must first be preheated before a casting operation begins, and for this to happen, measures must be taken that allow for preheating of the refractory.

Figure 3B:
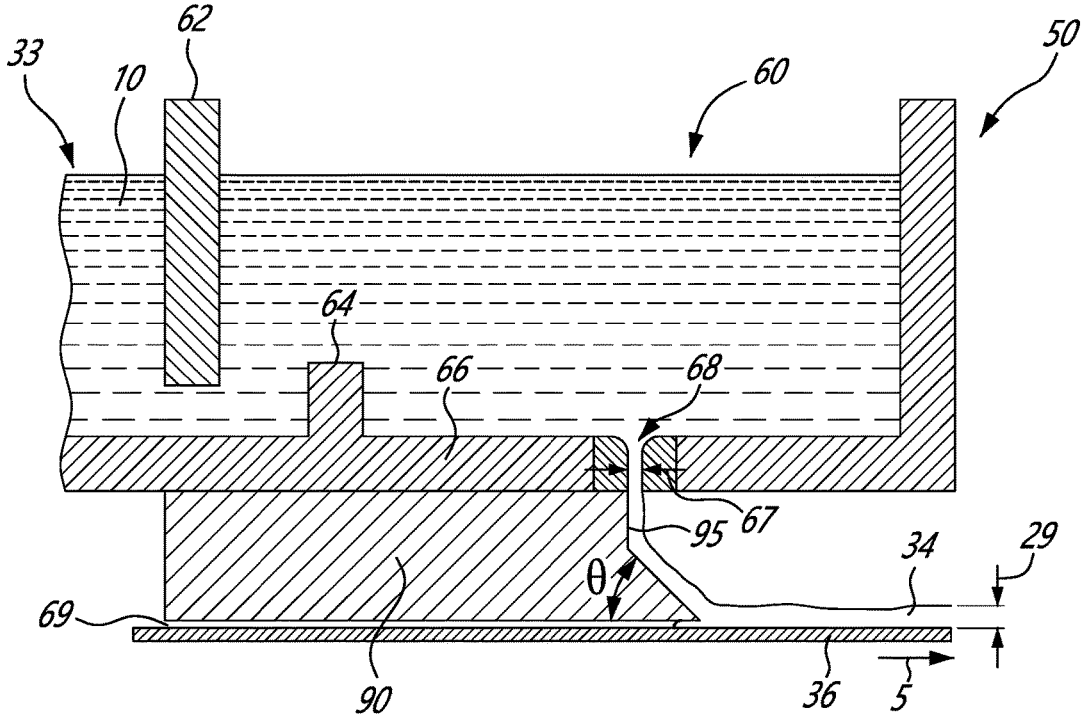
FIG. 3B is a cross-sectional view through a headbox, according to one embodiment of described herein.

In one preferred embodiment that is represented in FIG. 3B, the molten metal liquid 10 exiting the slot nozzle 68 from the bottom portion 66 of the headbox 50, may flow down a vertical back-wall 95, that is aligned with an angled back-wall 90. The vertical back-wall 95 in a preferred embodiment is aligned with an inner edge of the slot nozzle 68. This arrangement including a vertical back-wall reduces or eliminates any oscillation for the molten liquid metal 10.

Figure 3C:
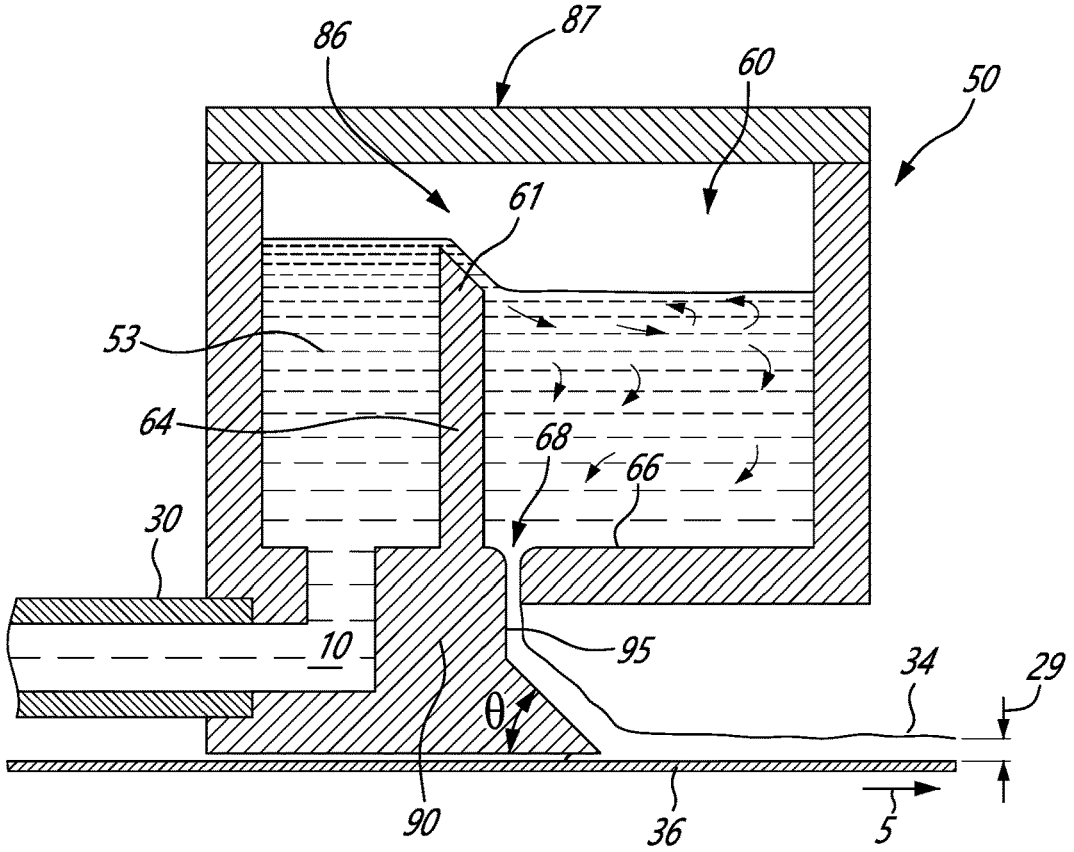
FIG. 3C is a cross-sectional view through a headbox, according to one embodiment of described herein.

FIG. 3C illustrates a two-compartment head box 86, for producing wider sheets of cast metal (0.5-2.5 m wide) more conveniently than using the system illustrated in FIG. 3B. The liquid metal 10 enters the head box 50 through a thermally insulated pipe, or duct 30, from the liquid metal supply system previously described. The liquid metal 10 enters the entry portion 53 of the head box 50, filling it laterally. So as to introduce a calmed liquid metal over an (impervious) weir 61 at the top of dam 64 as a flow regulator. The weir 61 creates a uniform flow of metal across the whole width of the second compartment 60 of the head box 50, containing the slot nozzle 68. As previously mentioned, the head boxes illustrated, are sealed. In FIG. 3C, a cover 87 is illustrated, and is gas shrouded, to prevent re-oxidation of the melt.

Figure 3D:
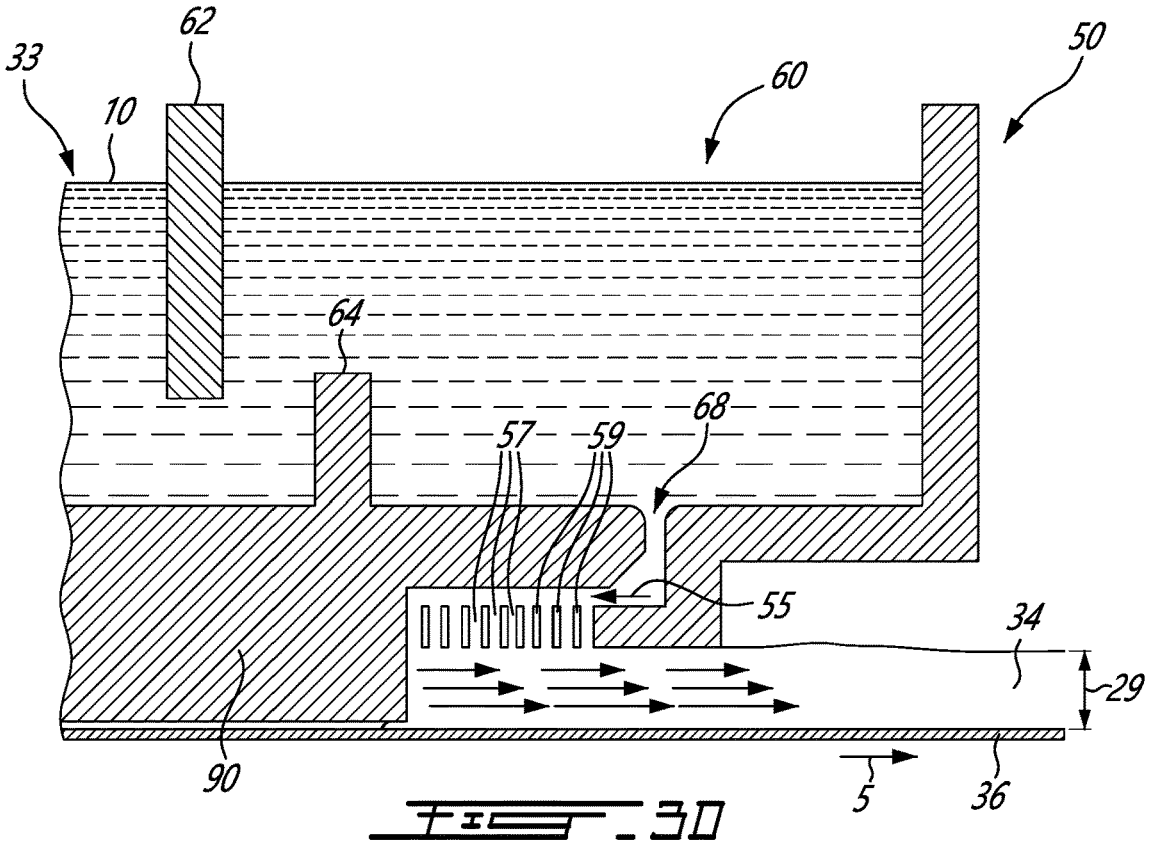
FIG. 3D is a cross-sectional view through a headbox, according to another embodiment of described herein, producing a thicker strip.

In another preferred embodiment represented in FIG. 3D for the production of thicker sheets, the molten metal liquid 10 exiting the slot nozzle 68 from the bottom portion 66 of the headbox 50, is designed to reverse the direction 55 from that of direction 5 of the substrate 36. The molten metal liquid 10 moves in a direction 55 and then down through series of narrow slots 57 defined by a plurality of flat (ceramic or metal) bars 59 that run the horizontal length 65 (in FIG. 4) of the slot nozzle 68 and serve as an iso-kinetic flow director for the molten metal liquid 10 (i.e. the bars 59 are flow directing elements). The number and the distance between the flat bars 59 may vary. In a preferred embodiment the distance between the flat bars 59 is 1 to 3 mm. The number of narrow slots 57 varies but in a preferred embodiment is between 5 and 20, and in a more preferred embodiment between 10 and 15. The headbox 50 and nozzle system of FIG. 3D permits the continuous casting of metal slabs of 10 to 20 mm. thicknesses, and preferably between 10 to 15 mm. thicknesses. This embodiment produces thicker metal slabs without any electromagnetic braking and high energy argon jets that are used on such slab thicknesses in the prior art.

Figure 4:
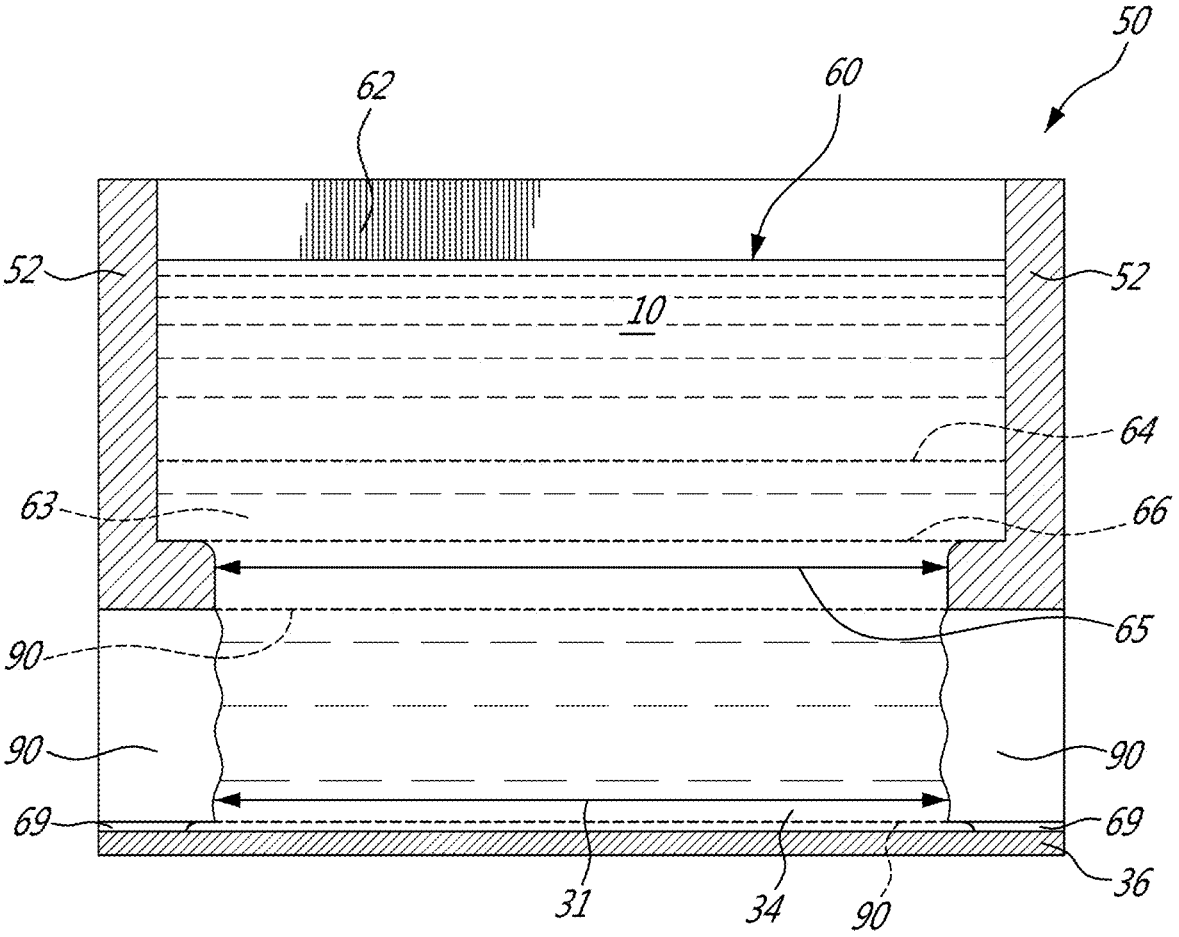
FIG. 4 is the cross-section through line 4-4 of FIG. 3A.

FIG. 4 is a cross-sectional view through line 4-4 of FIG. 3A, and illustrates the transverse features of compartment 60. The weir 62, sidewalls 52, dam 64 and opening 63 (in dotted lines) are represented. The slot width 67 of the slot nozzle 68 is clearly represented. The slot (horizontal) length 65 is defined between the sidewalls 52, and discharges liquid metal 10 onto the angled back-wall 90. The slot nozzle width 67 and slot nozzle length 65 will approximate the dimensions of the thickness and width (respectively) of the cast metal sheet 34. The apparatus and method described herein produces a metal strip 34 having a width 31 that is substantially equal to the slot nozzle length 65.

Figure 5:
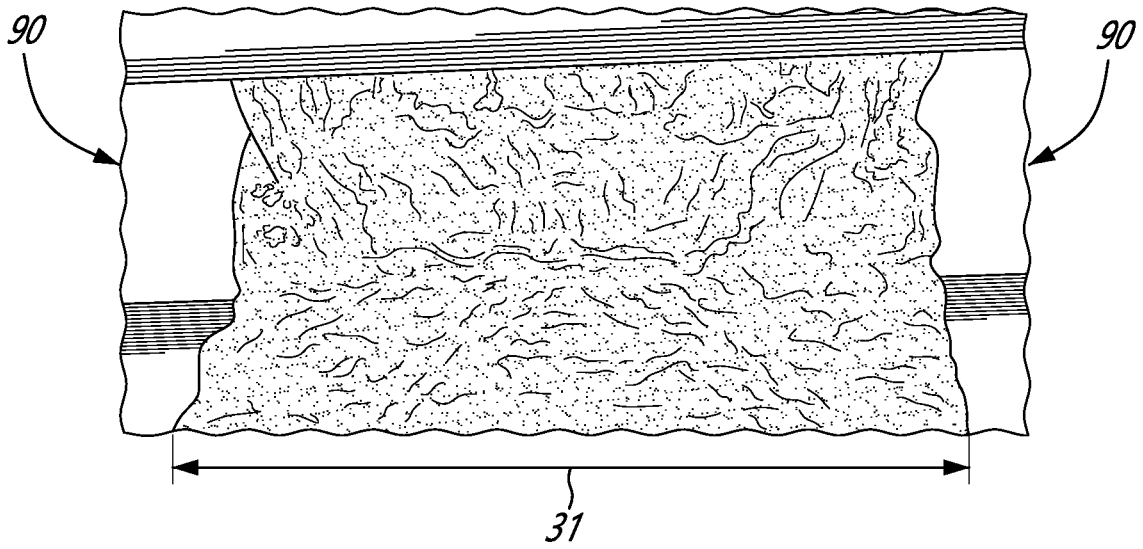
FIG. 5 is a photograph of the outlet of the headbox of FIG. 3A, illustrating flowing aluminum strip impacting the angled) (45° back wall, before freely flowing onto the moving belt.

FIG. 5 is a photograph of molten aluminum metal flowing down the angled back-wall 90 and a metal strip 34 having a strip width 31, produced on the chilled substrate 36 on the transporter 38 leaving the headbox 50 described herein. FIG. 5 quite clearly illustrates the generally controlled turbulent flow of liquid metal (i.e. generation of turbulent kinetic energy) down the back-wall 90. Turbulence is seen near and next to the angled back-wall 90, while the flow down the central portion of the back-wall 90 is perfectly smooth. There is more agitation on the chilled substrate 36, but in the foreground of FIG. 5 there appears to be a further laminar transition (i.e. a velocity adjusted manner or transition) on the chilled substrate.

It should be noted that once the metal strip 34 is cast, the width of the strip can in many cases be maintained along the length of the transporter 38, without or free of further guides or side dams along the carrier 38. As a result of this, the strip 34 formed by the present apparatus 1 and method is a good example of Near Net Shape Casting. The absence of side dams along the carrier 38 is visible in FIG. 6.

The present method and apparatus reduce the need for further shaping, surface finishing or other working of the strip/slab to reach the final shape required. Minimizing these further finishing steps has an advantageous role in reducing production costs.

Figure 7A:
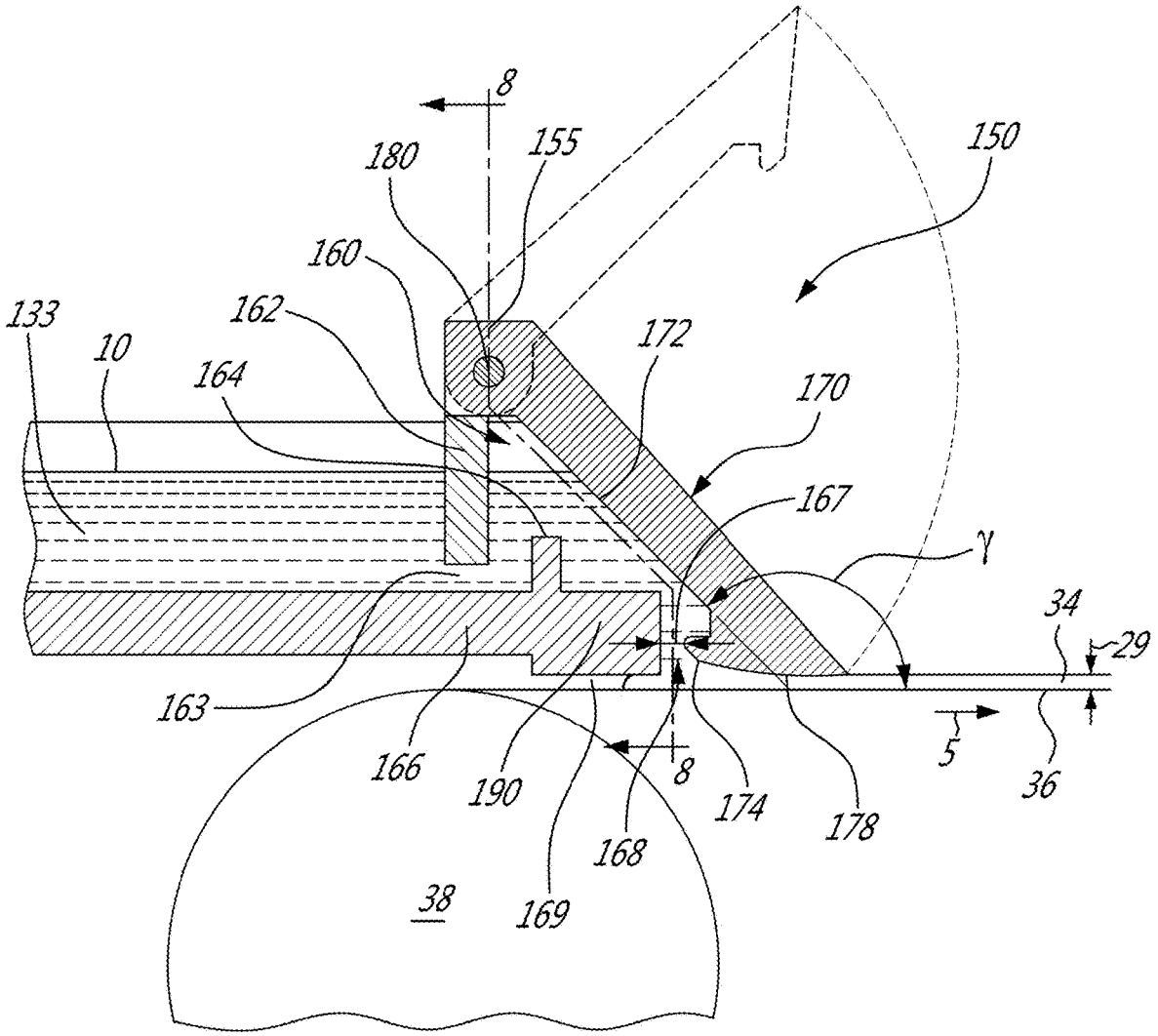
FIG. 7A is a cross-sectional view through a headbox, according to another embodiment described herein, producing a thin metal strip.

Another aspect of the method and apparatus described herein, is a design that similarly acts to generate turbulent energy by including a reverse flow system, that acts to destroy the forward momentum of the flow on the chilled substrate 36, and to reverse the flow, so as to impinge on the back wall 172 of the enclosed headbox 150 as illustrated in FIG. 7A. Kindly note that reference numerals used in FIG. 7A describe similar features as found in FIG. 3A but begin with a 1XX prefix. Therefore, similar features in FIG. 3A and FIG. 7A have the same names, i.e. the weir 62 of FIG. 3A is similarly identified as weir 162 in FIG. 7A.

The apparatus of FIG. 7A, combines the features of FIG. 3A specifically a smooth narrowing width slot nozzle, 68 with the sloped back-wall 90, into a slot nozzle 168 and an angled back-wall 172 within a chamber/compartment 160 wherein the angled back-wall is sealingly engaged to the opposite side walls 152. The headbox 150 produces whorls within the molten metal 10, so as to promote isokinetic flow of the liquid metal 10 towards the variable-height, slot nozzle 168. Similarly, the enhanced turbulence will render the whole of the extended cavity isothermal, and will help maintain flows at the back-wall's triple line meniscus gap 169, along the width of the chilled substrate 36 of the carrier 38.

Although the slot nozzle 168 can be varied through a pivoting device 180, it is generally maintained at a fixed slot width 167 during specific production runs.

The slot nozzle 168 is essentially an elongated—very narrow (2 to 6 mm), very wide (20 to 2000 mm), opening that creates a very wide, very thin strip of liquid metal. However, a process metallurgist understands that liquid metals have surface tensions that can be up to thirty times those of water. For instance, liquid steel is 1.8 N/m, whereas water is 0.07 N/m. i.e. 26 times greater. Therefore, the narrower the slot width 167, sw, say 2 mm, the greater are the surface tension forces pulling the liquid ends inwards with an inwards pressure force=$2\sigma/sw=(2\times1.8/0.002)=1800$ Newtons/$m^2$. So, the further a slot of liquid metal falls through space, the more time it has to minimize its area towards that of a cylinder in this case. As such, it is quite normal for an unconstrained stream of liquid metal to revert towards a cylindrical shape. However, if the drop height is kept very small, and the liquid metal is contacted with a freezing substrate, the area towards that of a cylinder can be minimized by freezing the bottom surface of the liquid metal, rapidly. Similarly, if we have an impact of liquid metal onto the belt, it will tend to spread out in all directions, including sideways and backwards, as well as forwards. So, the strip that forms, and freezes, can be wider, or less wide, or exactly the same width of the slot, depending on the actual forces at work during its freezing to form a solid. Computational Fluid Dynamics (CFD) to calculate all the interacting forces, can then predict the final sheet dimensions.

The headbox 150 similarly includes: an upstream launder 133; a weir 162, defining an opening between launder 133; and adjacent dam 164, within an upstream compartment 160, having an upper portion 155. The weir 162 and the dam 164 may once again be in a porous/pervious filtering material that helps to purify the molten metal 10.

However, the front wall 170 serves as a reverse flow generating device, includes additional features particularly an obtuse angle γ with the horizontal reverse flow generating wall 172, comprising the pivoting device 180 attached in the upper portion 155, that permits the opening or closing of the slot nozzle 168 that allows the varying of strip 34 thicknesses (through a radius shown in dashed lines). The obtuse angle γ between the wall 172 and the horizontal is from 120° to 160°, and in a preferred embodiment 135°. The front wall 170 further includes, a smooth curved edge 174 at the bottom of the generating wall 172, that is adjacent the bottom portion 166 (back-wall 190) of the headbox 150. The front wall 170 also has a rounded surface 178 at the base of the front wall 170, extending from the smooth curved edge 174 in direction 5 adjacent to the chilled carrier 38 to outer wall on the two outer side surfaces of the headbox 150 (not shown) and opposite angled reverse flow generating wall 172. The inner sides of the two sidewalls extend slightly beyond the length of the angled front wall 170 of the headbox 150, such that the two clearances laterally enclosing the liquid metal 10 on either side of the inner walls, are fitted and filled with thin, semi-hard, flexible, ceramic blankets, sealingly engaging the liquid metal 10. This allows the front wall 170 to pivot or move, without metal leaking out of the head box 150. An additional feature of this device, is to limit any expansion of the liquid metal sheet, prior to incipient freezing of the bottom metal in isokinetic contact with the moving cooling substrate (i.e. moving belt).

Figure 7B:
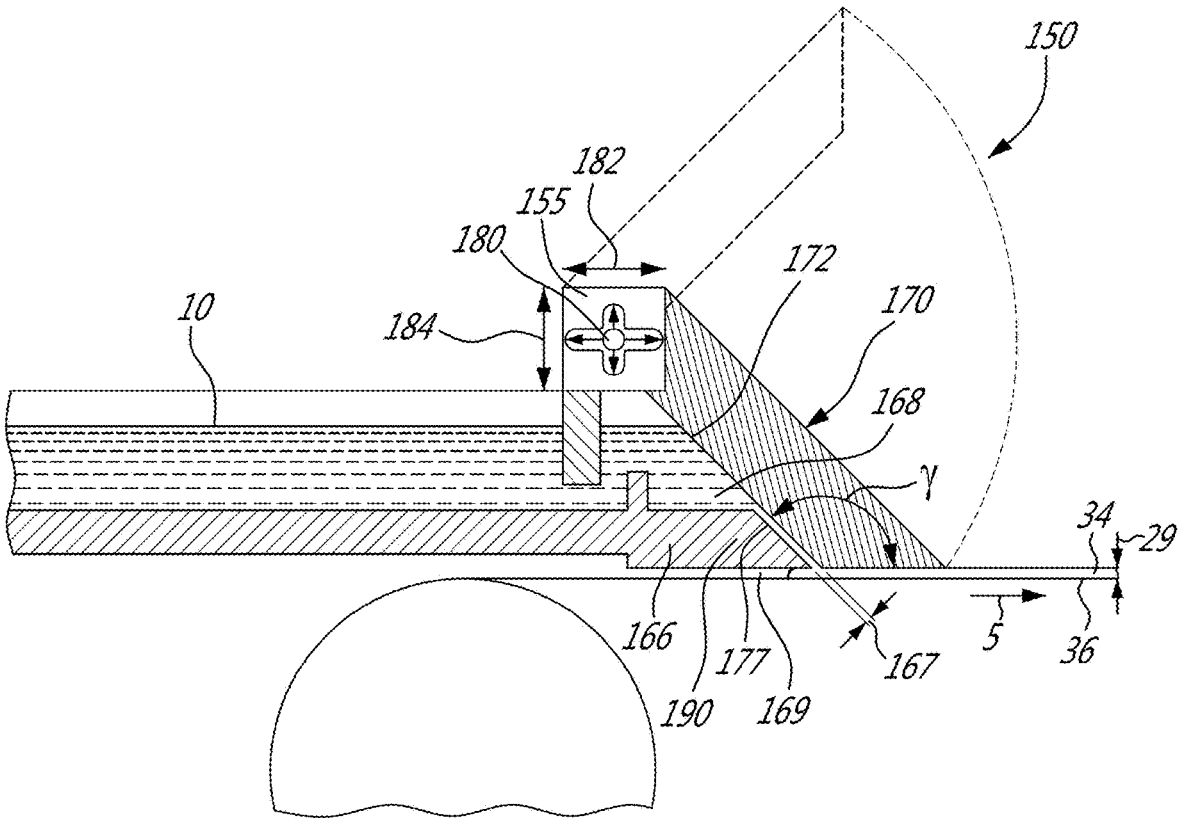
FIG. 7B is a cross-sectional view through a headbox, according to a further embodiment described herein, producing a thin metal strip.

In FIG. 7B another embodiment of front wall 170, a reverse flow generating device is illustrated. In this embodiment the bottom portion 166 includes an angled bottom portion 177 that is compatible and substantially parallel with the reverse flow generating wall 172, and defines the slot nozzle 168, having a slot nozzle width 167. A pivoting device 180 is illustrated, that maintains its pivoting functionality as previously described in FIG. 7A, and includes a functionality of fine horizontal movement adjustment 182 and fine vertical movement adjustment 184. This finer movement functionality around the pivot device 180 produces finer adjustment of the reverse flow generating device and can deliver a stream of liquid metal 10 through a narrow slot nozzle 168, that will enter onto the belt, at angles between 10-90°, with respect to the horizontal, for a desired thickness (e.g. 300 microns to 3 mm. thick), so as to produce a very thin, to thin sheet of material. It should be noted that the angle reverse flow generating wall 172 is substantially linear (and does not include the smooth curved edge (174). The liquid metal delivery system illustrated in FIG. 7B, is well adapted to produce a thin sheet material (<1 mm.), using a pivoting "wedge" system.

The minimum length of the extended compartment 160 is governed by the speed of the belt/substrate 36, together with considerations regarding the first moments of solidification of metal onto the belt. Previous work has shown that liquid aluminum and liquid steel will start freezing on a substrate 36 within about 30 ms.

Figure 6:
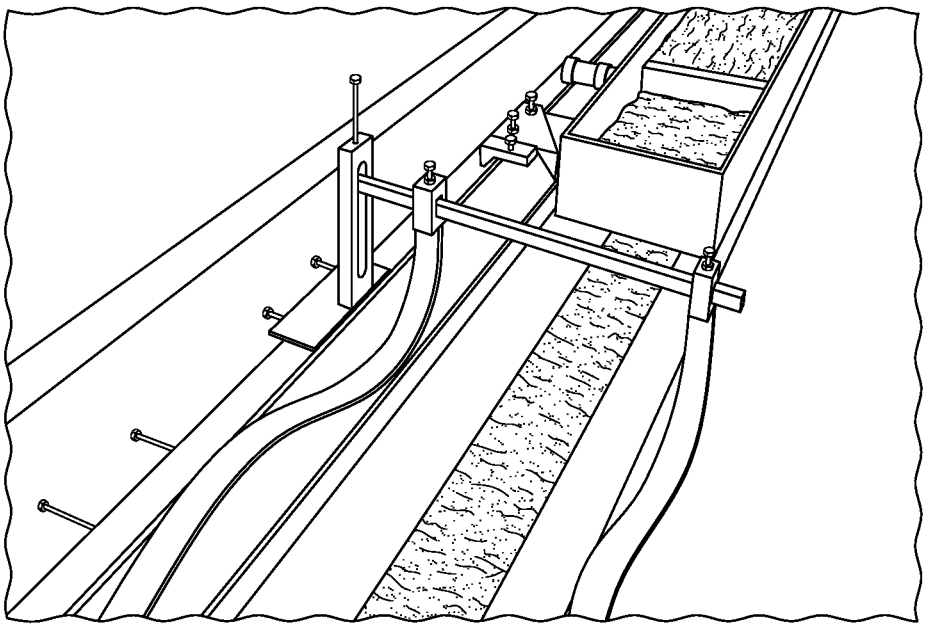
FIG. 6 is a detailed photograph of molten aluminum leaving the headbox of FIG. 4., the strip on the chilled transporter maintaining the width of the strip without any side-dams.

Consequently, for a belt speed of 1 m/s, the length, $L_c$, of the cavity, or enclosure, can be a minimum of $L_c=U_b\times\Delta t$, or $L_c=3$ cm. However, this can be extended appropriately, so as to constrain the forming sheet with attached side dams. These attached side dams prevent any side-flow of liquid metal onto the carrier 36 that can occur in the case of a completely unrestrained system (FIG. 6).

In an option not illustrated here, the carrier 36 can include moving side dams on either side when thicker strips are being cast (e.g. ≤7 mm), so as to contain any overflowing material. Previous work on aluminum and steel melts have shown that strips up to about 7 mm thickness can be cast with no moving side-dams, thanks to constraining surface tension and non-wetting of the substrate effects.

As previously noted there is a need to restrict the back meniscus gap 169 between the back-wall of the enclosure, and the belt, to a maximum of 1 mm. Beyond this separation distance, backflow of liquid metal 10 can take place, resulting in possible freezing of melt between the angled wall 172 and the moving belt/substrate 36. This could lead to destruction of the angled wall 172, and the prevention of further strip casting activities. Similarly, it can be helpful to angle the bottom of the angled wall 172, by 30-70 degrees from the vertical, as well as sidewalls 40, if necessary, so as to better guide the edge flows of liquid metal. The angled wall 166 of the delivery system must first be preheated before a casting, and for this to happen, measures must be taken that allow for preheating of the refractory. In the example shown in FIG. 7, the angled wall 166 is first preheated away from the headbox 150, either in an electric furnace, or by gas flames, to the required temperature. It is then slipped around the Stainless Steel Metal Plate, forming the base and sides of the refractory head box, and secured in place. Similarly, the castable refractory contained within the adjustable head reverse flow generating device 172 of the extended cavity can be preheated, by rotating it about the pivot device 180 up to the second position through and directly preheated by a gas burner.

Figure 8:
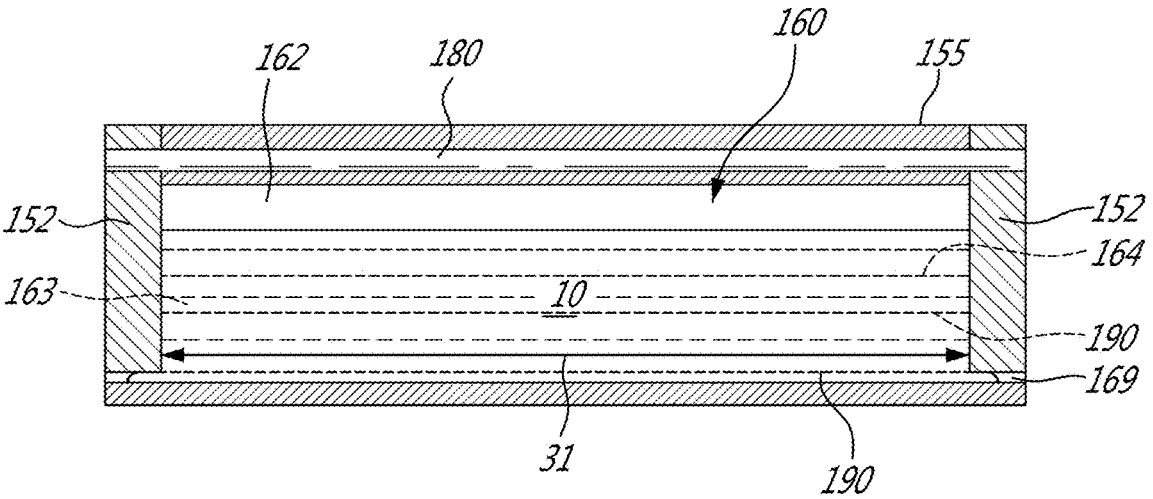
FIG. 8 is the cross-section through line 8-8 of FIG. 7A.

FIG. 8 is a cross-sectional view through line 8-8 of FIG. 7A, and illustrates the transverse features of compartment 160. The weir 162, sidewalls 152, dam 164 and opening 163 (in dotted lines) are represented elongated. The slot width 167 of the slot nozzle 168 is clearly represented. The slot (horizontal) length 165 is defined between the sidewalls 152, and discharges liquid metal 10. The slot nozzle width 167 and slot nozzle length 165 will approximate the dimensions of the thickness 29 and width 31 (respectively) of the cast metal sheet 34.

Therefore, the presently described method and apparatus are well adapted to attain the ends and advantages mentioned as well as those that are inherent therein. The particular embodiments disclosed above are illustrative only, as the present invention may be modified and practiced in different ways that are apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope described herein. While the method and apparatus are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the set out here have their plain, ordinary meaning unless otherwise explicitly and clearly defined herein. Moreover, the indefinite articles "a" or "an", as used in the claims, are defined herein to mean one or more than one of the element that it introduces.

The invention claimed is:

1. An apparatus (1) for continuous Near Net Shape casting of a liquid metal (10) into a metal strip (34) having a strip width (31) and a strip thickness (29) on a chilled substrate (36) moving in a first direction (5), the apparatus (1) comprising:

a head box (50) proximal to and above the chilled substrate (36), wherein the head box (50) is adjacent to and hydraulically connected to a launder (33) supplying the liquid metal (10), the head box (50) comprising:

a compartment (60) receiving the liquid metal (10) from the launder (33), the compartment (60) comprising a front wall (70) comprising an internal wall (72) within the compartment (60);

two opposite side walls (52) attached to the front wall (70), a weir (62) attached to the two opposite side walls (52) and opposite the front wall (70), a bottom portion (66) attached to each of the front wall (70), the two opposite side walls (52) and the weir (62) wherein a combination of the bottom portion (66), the front wall (70), the two opposite side walls (52) and the weir (62) retaining the liquid metal (10); and a dam (64) in the bottom portion (66) positioned longitudinally between the two opposite side walls (52) and located between the weir (62) and the internal wall (72);

wherein the weir (62) defining an opening (63) adjacent to the bottom portion (66) allowing passage of the liquid metal (10) into the compartment (60);

wherein the bottom portion (66) defining a slot nozzle (68) above the chilled substrate (36), and an angled back-wall (90) positioned longitudinally between the two opposite side walls (52) and located between the bottom portion (66) and the chilled substrate (36), wherein the slot nozzle is located between the dam (64) and the internal wall (72), the slot nozzle (68) defining an elongated cavity with a slot width (67) and a slot length (65) in the bottom portion (66), the slot width (67) defined between the dam (64) and the internal wall (72) and the slot length (65) defined between the two opposite side walls (52), the slot nozzle (68) transferring the liquid metal to the angled back-wall (90), wherein the elongated cavity is located above the angled back-wall (90), and wherein the angled-back wall (90) and the chilled substrate (36) are separated by a meniscus gap (69).

2. The apparatus of claim 1, wherein the slot width (67) is less than, equal to, or greater than the strip thickness (29).

3. The apparatus of claim 1, wherein the angled back-wall (90) has a slope that makes an acute angle θ with the horizontal in relation to the metal strip (34) and is from 30° to 70°.

4. The apparatus of claim 3, wherein the acute angle θ is 45°.

5. The apparatus of claim 1, wherein the angled back-wall has an upper portion that is a vertical back-wall (95) located below and in-line with the elongated cavity.

6. The apparatus of claim 5, wherein a slot width (67) is defined between a first nozzle wall and a second nozzle wall in the bottom portion (66), the first nozzle wall proximal the dam (64) and the second nozzle wall opposite the first nozzle wall, and wherein the vertical back-wall (95) is aligned with the first nozzle wall.

7. The apparatus of claim 5, wherein the dam (64) further comprises an upper weir (61) regulating the flow of liquid metal into the compartment (60).

8. The apparatus of claim 1, wherein the bottom portion includes an downwardly projecting arm below the slot nozzle (68) adapted to move the liquid metal in a second direction (55) opposite the first direction (5) towards the angled back wall (90) and then downward through a plurality of flow directing elements before dropping onto the chilled substrate (36).

9. An apparatus (1) for continuous Near Net Shape casting of a liquid metal (10) into a metal strip (34) having a strip width (31) and a strip thickness (29) on a chilled substrate (36) moving in a first direction (5), the apparatus (1) comprising:

a head box (150) proximal to and above the chilled substrate (36), wherein the head box (150) is adjacent to and hydraulically connected to a launder (133) supplying the liquid metal (10), the head box (150) comprising:

a compartment (160) receiving the liquid metal (10) from the launder (33), the compartment (160) comprising an upper portion (155) and a bottom portion (166) opposite the upper portion (155);

an angled front wall (170) comprising an internal wall (172) within the compartment wherein the angled front wall (170) is attached to the upper portion (155) through a pivoting device (180);

two opposite side walls (152) proximal to and sealingly engaging the angled front wall (170);

a weir (162) attached to the two opposite side walls and opposite the angled front wall (170);

a bottom portion (166) attached or proximal to each of the angled front wall (170), the two opposite side walls (152) and the weir (162) wherein a combination of the bottom portion (166), the angled front wall (170), the two opposite side walls (152) and the weir (162) retaining the liquid metal (10); and a dam (164) in the bottom portion (166) positioned longitudinally between the two opposite side walls (152) and located between the weir (162) and the internal wall (172), wherein the weir (162) defining an opening (163) adjacent to the bottom portion (166) allowing passage of the liquid metal (10) into the compartment (160);

wherein the bottom portion (166) serving as a back-wall (190) proximal to the internal wall (172) defining a slot nozzle (168) therebetween and above the chilled substrate (36), and wherein the slot nozzle defining an elongated cavity with a slot width (167) and a slot length (165), the slot width (167) defined between the back-wall (190) and the internal wall (172) and the slot length (165) defined between the two opposite side walls (152), the slot nozzle (168) transferring the liquid metal to the chilled substrate (36), wherein the back wall (190) and the chilled substrate (36) are separated by a meniscus gap (169) and wherein the front wall (170) is movable around the pivoting device (180) and capable of increasing or decreasing the slot width (167).

10. The apparatus of claim 9, wherein the internal wall (172) makes an obtuse angle γ with the horizontal in relation to the metal strip (34) and is from 120° to 160°.

11. The apparatus of claim 10, wherein the obtuse angle γ is 135°.

12. The apparatus of claim 10, wherein the back wall (190) makes an acute or perpendicular angle with the horizontal in relation to the metal strip (34).

13. The apparatus of claim 12, wherein the acute angle is substantially parallel with the obtuse angle.

14. The apparatus of claim 9, wherein the internal wall (172) comprises a lower surface having a curved edge (174) adjacent to the chilled substrate (36) curving outwardly towards and proximal with the back-wall (190) and defining the slot nozzle (168) therebetween, wherein the curved edge (174) is adapted to move the liquid metal (10) out of the slot nozzle (168) at least partially in a second direction opposite the first direction (5).

15. The apparatus of claim 14, wherein the internal wall (172) further comprises a rounded surface (178) projecting from the curved edge (174) adjacent the back-wall (190) in the first direction (5) adjacent the chilled substrate (36).

16. The apparatus of claim 15, wherein the internal wall (172) comprises a straight wall lower surface aligned with the back-wall (190) having an angled bottom portion (177) and defining the slot nozzle (168) therebetween, wherein the curved edge (174) proximal the chilled substrate (36) is adapted to move the liquid metal (10) out of the slot nozzle (168) at least partially in a second direction opposite the first direction (5).

17. The apparatus of claim 9, wherein the pivoting device (180) pivots around one line parallel to the front wall (170).

18. The apparatus of claim 9 wherein the pivoting device (180) pivots around one line parallel to the front wall (170) and further comprises at least one of a fine horizontal movement adjustment (182) and a fine vertical movement adjustment (184) providing a fine adjustment to the slot width (167) varying the strip thickness (29).

19. A method for continuous Near Net Shape Casting of a liquid metal (10) into a metal strip (34) having a strip width (31) and a strip thickness (29) on a chilled substrate (36) moving in a first direction (5), the method comprising:

transferring the liquid metal (10) to a head box in a controlled manner, the head box comprising:

a compartment receiving and calming the liquid metal, the compartment comprising an upper portion and a bottom portion (166) opposite the upper portion;

a front wall movably attached in the upper portion, the front wall comprising an internal wall within the compartment reversing the flow of the liquid metal at least partially in a second direction opposite the first direction (5), wherein the internal wall adjacent to the bottom portion and defining a slot nozzle therebetween;

wherein the slot nozzle defining an elongated cavity with a slot width and a slot length, the slot width is adjustable and defined in the first direction and the slot length is defined in a plane perpendicular the first direction (5), and transferring the liquid metal (10) in a velocity adjusted manner through the slot nozzle at least partially in the second direction to the chilled substrate (36) above a meniscus gap defined between the bottom portion and the chilled substrate (36).

20. The method of claim 19, wherein the slot length is greater than or less than the strip width (31).

21. The method of claim 19, wherein the slot length is equal to the strip width (31).

22. The apparatus of claim 19, wherein the slot width is less than, equal to, or greater than the strip thickness (29).

* * * * *